US008622047B2

(12) United States Patent
Blom et al.

(10) Patent No.: US 8,622,047 B2
(45) Date of Patent: Jan. 7, 2014

(54) CLEANING A PRESSURE CONTROL FUNCTION VALVE

(75) Inventors: Johan Blom, Gotenborg (SE); Wakichi Kondo, Gotenborg (SE)

(73) Assignee: Denso Corporation, Kariya (JP)

( * ) Notice: Subject to any disclaimer, the term of this patent is extended or adjusted under 35 U.S.C. 154(b) by 634 days.

(21) Appl. No.: 12/923,509

(22) Filed: Sep. 24, 2010

(65) Prior Publication Data

US 2012/0073546 A1 Mar. 29, 2012

(51) Int. Cl.
*F02M 59/36* (2006.01)

(52) U.S. Cl.
USPC ..... 123/458; 123/198 D

(58) Field of Classification Search
USPC ..... 123/457, 458, 506, 198 D; 137/239, 137/493.3, 512.2
See application file for complete search history.

(56) References Cited

U.S. PATENT DOCUMENTS 4,577,606 A * 3/1986 Bohringer et al. ..... 123/506
4,770,150 A * 9/1988 Fraenkle et al. ..... 123/510
4,964,391 A * 10/1990 Hoover ..... 123/510
4,969,697 A * 11/1990 Lindenman ..... 303/113.5
5,148,792 A * 9/1992 Tuckey ..... 123/497
5,311,901 A * 5/1994 Ostrom ..... 137/493.3
5,339,785 A * 8/1994 Wilksch ..... 123/457
5,373,829 A * 12/1994 Schuers et al. ..... 123/510
5,477,829 A * 12/1995 Hassinger et al. ..... 123/467
5,501,196 A * 3/1996 Brunnhofer ..... 123/497
5,572,974 A * 11/1996 Wakeman ..... 123/497
5,623,910 A * 4/1997 Riggle ..... 123/510
5,630,399 A * 5/1997 Nomura et al. ..... 123/467
5,673,670 A * 10/1997 Powell et al. ..... 123/463
5,765,537 A * 6/1998 Coleman et al. ..... 123/514
5,785,025 A * 7/1998 Yoshiume et al. ..... 123/497
5,833,765 A * 11/1998 Flynn et al. ..... 134/22.12
5,950,669 A * 9/1999 Fehlmann et al. ..... 137/493.3
6,024,064 A * 2/2000 Kato et al. ..... 123/179.17
6,352,067 B1 * 3/2002 Genslak ..... 123/510
6,601,565 B2 * 8/2003 Tofan-Petre ..... 123/457
6,837,219 B2 * 1/2005 York et al. ..... 123/457
6,988,488 B2 * 1/2006 Pursifull et al. ..... 123/467
7,441,545 B1 * 10/2008 Fisher et al. ..... 123/467
7,444,990 B1 * 11/2008 Fisher et al. ..... 123/459
2006/0231080 A1 * 10/2006 Tomatsuri et al. ..... 123/516

* cited by examiner

*Primary Examiner* — Thomas Moulis
(74) *Attorney, Agent, or Firm* — Nixon & Vanderhye P.C.

(57) ABSTRACT

A system and method cleans a fuel pump pressure control function valve having (i) an orifice linking a first region (e.g., a high pressure region) and a second region (e.g., a low pressure region) and (ii) a closing member biased to close the orifice when fuel pressure in the first region is below a threshold pressure. Cleaning the valve may include increasing the pressure in the first region to an overpressure condition, thereby causing the closing member to be moved to open the orifice such that a rapid flow of fuel occurs from the first region to the second region. A pressure control function valve can therefore be conveniently cleaned without requiring engine disassembly or adding additional physical elements. The fuel pump pressure control function valve may be part of safety or check valve of a fuel pump.

20 Claims, 7 Drawing Sheets

32
34
36
40
41

CLEANING A PRESSURE CONTROL FUNCTION VALVE

FIELD

The present disclosure relates to a valve and more particularly, but not exclusively, to a pressure control function valve.

BACKGROUND

In a gasoline direct injection engine, fuel may be carried from a fuel tank under force provided by a low pressure fuel pump located at or in the fuel tank and the fuel may be further pressurised for use by a fuel injector by a high pressure fuel pump located near the fuel injector.

Example embodiments of the present invention have been made in the light of the drawbacks and difficulties of known systems.

SUMMARY

Viewed from a first aspect, there can be provided a method of cleaning a fuel pump pressure control function valve having an orifice linking a first region and a second region, and a closing member biased to close the orifice when fuel pressure in the first region is below a threshold pressure. The method of cleaning the valve may comprise: increasing the pressure in the first region to an overpressure condition, thereby causing the closing member to be moved to open the orifice such that a rapid flow of fuel occurs from the first region to the second region. Thus a pressure control function valve can be conveniently cleaned without a requirement for engine disassembly and without a requirement to add additional physical elements.

In one example, the fuel pump pressure control function valve may be mounted in a fuel pump comprising a safety valve, and increasing the pressure in the first region to an overpressure condition may comprise increasing the pressure in the first region to a pressure over the threshold pressure of the safety valve. Thus oscillation of the safety valve may be triggered to further facilitate cleaning. Increasing the pressure in the first region to an overpressure condition may comprise increasing the pressure in the first region to between 15 and 25 MPa. The fuel pump pressure control function valve may be mounted in the safety valve. Increasing the pressure in the first region to a pressure over the threshold pressure of the safety valve may comprise increasing the pressure in the first region to between 1 and 2 MPa greater than the threshold pressure of the safety valve.

With respect to the above method, the fuel pump pressure control function valve may be mounted in a fuel pump comprising a check valve, wherein the fuel pump pressure control function valve is mounted in the check valve. The fuel pressure control function valve may be mounted in a high pressure fuel pump configured to deliver pressurised fuel to a high pressure fuel rail, wherein the first region is in fluid communication with the high pressure fuel rail.

Viewed from another aspect, there can be provided an engine management system comprising: a fuel pressure control output arranged to convey a fuel pump control signal; and a fuel pump control manager arranged to decide when a fuel pump pressure control function valve cleaning cycle should take place. The fuel pump control manager may be further arranged to adjust the fuel pump output control signal to cause the fuel pump to increase output pressure to an overpressure condition in response to the fuel pressure decider deciding that a fuel pump pressure control function valve cleaning cycle should take place. Thus an engine management system can control operation of a pressure control function valve cleaning cycle to thus provide for effective management of the valve operation.

With respect to the above engine management system, the overpressure condition may comprise increasing the pressure to between 15 and 25 MPa. The fuel pump may comprise a safety valve, and the overpressure condition may comprise increasing the pressure to a pressure over the threshold pressure of the safety valve. The fuel pump pressure control function valve may be mounted in the safety valve. The pressure over the threshold pressure of the safety valve may be between 1 and 2 MPa higher than the threshold pressure of the safety valve. The fuel pump may comprise a check valve and the fuel pump pressure control function valve may be mounted in the check valve. The fuel pump control manager may be arranged to decide that a fuel pump pressure control function valve cleaning cycle should take place following an engine stop.

Viewed from another aspect, there can be provided a pressure control function valve for a high pressure fuel pump, the valve comprising: a pressure return orifice via which high pressure fuel can escape from a high pressure region to a low pressure region; and a closing member operatively biased to close the pressure return orifice when the fuel pressure is below a threshold pressure. The pressure return orifice may be arranged to be cleaned by use of an overpressure condition in the high pressure region. Thus a valve which can easily be cleaned without an increased complexity of construction can be provided.

With respect to the above pressure control function valve, the overpressure condition may comprise a pressure in the high pressure region of between 15 and 25 MPa. The above pressure control function valve may be mounted in a fuel pump comprising a safety valve and the overpressure condition may comprise a pressure in the high pressure region higher than the threshold pressure of the safety valve. The fuel pump pressure control function valve may be located in the safety valve. The pressure in the high pressure region higher than the threshold pressure of the safety valve may be between 1 and 2 MPa higher than the threshold pressure of the safety valve. The above pressure control function valve may be mounted in a fuel pump comprising a check valve and the fuel pump pressure control function valve may be mounted in the check valve. The above pressure control function valve may be mounted in a high pressure fuel pump configured to deliver pressurised fuel to a high pressure fuel rail and the high pressure region may be in fluid communication with the high pressure fuel rail.

Viewed from a further aspect, there can be provided a method for cleaning a pressure control valve having a fuel return orifice and a closing member operatively biased to close the fuel return orifice. The method may comprise: increasing the pressure of a high pressure side of the pressure control function valve such that the closing member is forced away from the fuel return orifice to enable a flow of fuel through the fuel return orifice and thus applying a cleaning flow of fuel through the fuel return orifice. By this method, a pressure control function valve can be cleaned without a need to provide additional elements dedicated to a cleaning function.

With respect to the above method, increasing the pressure of a high pressure side of the pressure control function valve may comprise increasing the pressure in the first region to between 15 and 25 MPa. The fuel pump pressure control function valve may be mounted in a fuel pump comprising a safety valve, and increasing the pressure of a high pressure side of the pressure control function valve may comprise increasing the pressure in the first region to a pressure over the threshold pressure of the safety valve. The fuel pump pressure control function valve may be located in the safety valve. Increasing the pressure in the first region to a pressure over the threshold pressure of the safety valve may comprise increasing the pressure in the first region to a pressure between 1 and 2 MPa higher than the threshold pressure of the safety valve. The fuel pump pressure control function valve may be mounted in a fuel pump comprising a check valve and the fuel pump pressure control function valve may be mounted in the check valve. The fuel pressure control function valve may be mounted in a high pressure fuel pump configured to deliver pressurised fuel to a high pressure fuel rail and the high pressure side may be in fluid communication with the high pressure fuel rail.

Viewed from another aspect, there can be provided a fuel pump pressure control function valve, comprising: a pressure return orifice linking a first region and a second region; and a closing member biased to close the pressure return orifice when fuel pressure in the first region is below a threshold pressure. The valve may be configured to permit a rapid flow of fuel through the pressure return orifice from the first region to the second region when subjected to an overpressure condition in the high pressure region. Thus a valve which is straightforward to clean and of simple construction can be provided.

Viewed from a further aspect, there can be provided an engine management system comprising: a fuel pressure control output arranged to output a fuel pump control signal; and a fuel pressure decider arranged to decide when a fuel pump pressure control function valve cleaning cycle should take place. The fuel pressure control output may be further arranged to adjust the fuel pump output control signal to cause the fuel pump to increase output pressure to an overpressure condition in response to the fuel pressure decider deciding that a fuel pump pressure control function valve cleaning cycle should take place. Thus management of a fuel pump pressure control function valve can be effected to enable appropriate cleaning to take place without hindering normal engine operation.

Viewed from another aspect, there can be provided a method of controlling a fuel delivery system of an engine, the method comprising: determining that a fuel pump pressure control function valve cleaning operation should take place; triggering the fuel pump pressure control function valve cleaning operation by controlling a fuel pump having a fuel pump pressure control function valve to generate an overpressure condition, thereby to cause the fuel pump pressure control function valve to be opened and to allow a sustained flow of fuel therethrough during the cleaning operation. Thus a fuel delivery system can be provided which is self-cleaning and of straightforward mechanical construction.

BRIEF DESCRIPTION OF THE DRAWINGS

For a better understanding of the disclosed concepts and to show how the same may be carried into effect reference is now made by way of example to the accompanying drawings in which.

DETAILED DESCRIPTION OF PRESENT

Non-Limiting Example Embodiments

A number of examples of approaches for cleaning a pressure control function valve will be described with reference to the accompanying drawings. These approaches are illustrative in nature and serve to provide teachings of various concepts.

Figure 1:
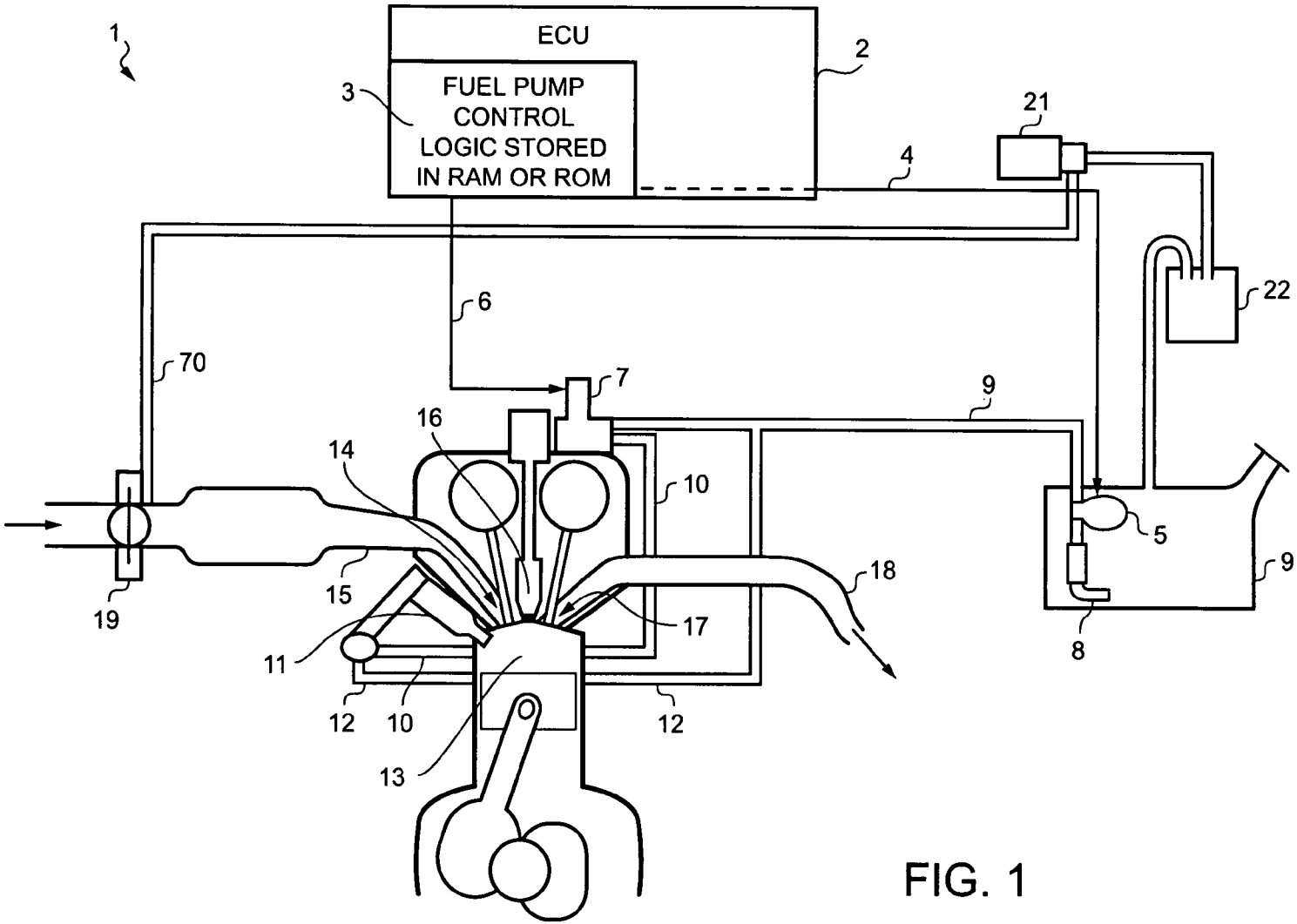
FIG. 1 shows schematically a number of parts of a gasoline direct injection engine in accordance with a present, non-limiting example embodiment.

FIG. 1 shows schematically a number of parts of a gasoline direct injection engine. Although the present examples are discussed in relation to a gasoline direct injection engine, the disclosed concepts may also be applied to other engines where a high pressure fuel pump is used, including gasoline indirect injection engines and diesel engines. The engine system 1 as illustrated in FIG. 1 includes an engine, a fuel storage and delivery system, and an engine control system.

An engine control unit (ECU) 2 (also referred to as an engine management unit) receives inputs from various sensors (not shown) providing data on various operational parameters of the engine and from a driver of a vehicle into which the engine is fitted. These sensors may include, for example, a crank sensor indicating rotation of the crankshaft, engine camshaft sensors indicating the timing of the rotation of intake and exhaust camshafts, exhaust gas sensors (e.g., oxygen sensors) a throttle angle sensor, pressure sensors and temperature sensors. The engine control unit 2 also provides control signals to various elements relating to the operation of the engine. For clarity, only control signals relating to fuel delivery are shown in FIG. 1. However, those skilled in the art will appreciate that the ECU 2 communicates other signals to/from other sensors such that the ECU 2 is able to monitor and control operating parameters such as engine speed, engine load, etc.

A functional part of the engine control unit 2 is fuel pump control logic 3. The fuel pump control logic 3 provides the control outputs relating to fuel delivery. These can include a control signal 4 to a low pressure fuel pump 5 and a control signal 6 to a high pressure fuel pump 7. The control signal 6 may include, for example, a signal to control operation of the high pressure fuel pump 7 to ensure appropriate synchronicity of operation with the firing of the cylinders of the engine.

Figure 10:
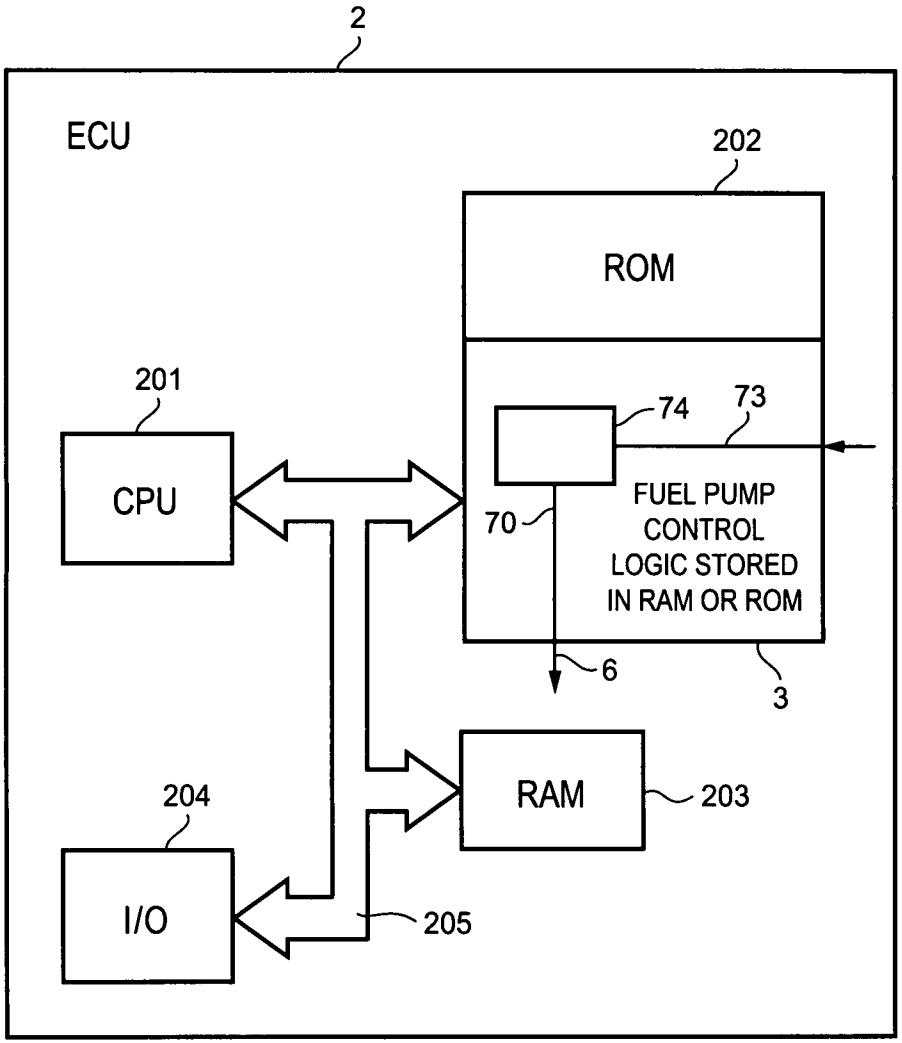
FIG. 10 illustrates functional elements of a control, which may be utilized for example in the engine illustrated in FIG. 1.

With reference to FIGS. 1 and 10, the ECU 2 may include a central processing unit (CPU) 201 for executing programmed logic (thereby forming programmed logic circuitry); a ROM 202 for storing control data and control programs (programmed logic) such as the fuel pump control logic 3 (or fuel pump management logic), fuel pressure decision logic for deciding that a fuel pump pressure control function valve cleaning cycle should take place; a RAM 203 for storing various data and/or programmed logic; an input/output circuit 204 for communicating data signals to/from devices such as the sensors noted above; and a bus line 205. The CPU 201 of the ECU 2 executes, for example, the procedure of the programmed fuel pump control logic 3 (or fuel pump management logic), fuel pressure decision logic etc. to thereby form programmed logic circuitry of fuel pump controller (or fuel pump control manager), a fuel pressure decision unit (or decider), etc.

While FIG. 10 shows a ROM 202 (or RAM 203) as a non-transitory computer readable storage medium for storing programmed logic such as the programmed fuel pump control logic 3 (or fuel pump management logic) and fuel pressure decision logic, the programmed logic can instead be accessed from a portable storage medium separate from an engine control unit 2. The portable storage medium may be, for example, a CD-ROM, a DVD, an SD (secure digital) card, a CF (compact flash) card, a SmartMedia card, a memory stick, a MMC (multimedia card), or a portable hard disc drive.

The fuel storage and delivery system provides for fuel to be taken through an inlet 8 from a fuel tank 9 containing gasoline fuel and fed by the low pressure fuel pump 5 into a low pressure fuel rail (or pipe) 9. The low pressure fuel rail 9 may typically operate at a fuel pressure of around 400 kPa nominal with an operating range boundary of between around 300 kPa and 500 kPa. The low pressure fuel rail 9 feeds the high pressure fuel pump 7. Via a process that will be described in greater detail below, the high pressure fuel pump 7 feeds the fuel to a high pressure fuel rail (or pipe) 10. The high pressure fuel rail 10 in turn carries the high pressure fuel to a fuel injector 11. The high pressure fuel rail 10 may typically operate at a fuel pressure of 8 MPa, although working pressures within the range of around 5 to 20 MPa are also possible. Any excess pressure at the injector can be relieved by allowing relief through an optional return fuel rail 12 which, if provided, carries any fuel released in this way back to the low pressure fuel rail 9. A fuel filter may be fitted within the fuel storage and delivery system to remove particulate matter within the fuel. This may be provided at or in advance of the low pressure fuel pump 5 or at or in advance of the high pressure fuel pump 7.

The injector 11, as the present example is illustrated with respect to a direct injection engine, provides for injection of fuel (under control from the engine control unit 2) directly into an engine cylinder 13. As is conventional, the cylinder includes a piston which is driven reciprocally by repeated combustion cycles, which reciprocal motion of the cylinder causes rotational movement of a crankshaft. In order to provide for the combustion in each combustion cycle, air can be admitted into the cylinder 13 via one or more inlet valves 14 from an air feed 15. A fuel/air mixture within the cylinder 13 can be ignited by a spark plug (or other ignition source) 16 and the combustion products can exit the cylinder via one or more outlet valves 17 to an exhaust system 18. As will be appreciated, the operation of the cylinder valves and spark plug can be controlled by the engine control unit 2.

The rate of air admittance to the engine via the air feed 15 can be regulated by a throttle 19. Also connected to the air feed is a purge/EVAP system (evaporative emission control system) which operates to avoid emission leakage from the fuel tank by leading any evaporated fuel from the fuel tank to the engine. Thus evaporated fuel from the tank can travel to the purge canister 22 where the fuel is adsorbed then at selected times the purge valve 21 can be opened to draw the adsorbed fuel from the canister and down line 20 to the engine inflow.

Thus, there has now been described an example of an engine utilising a high pressure fuel pump 7 to pressurise fuel from a low pressure fuel rail 9 to a high pressure fuel rail 10 for delivery to a fuel injector 11.

Figure 2:
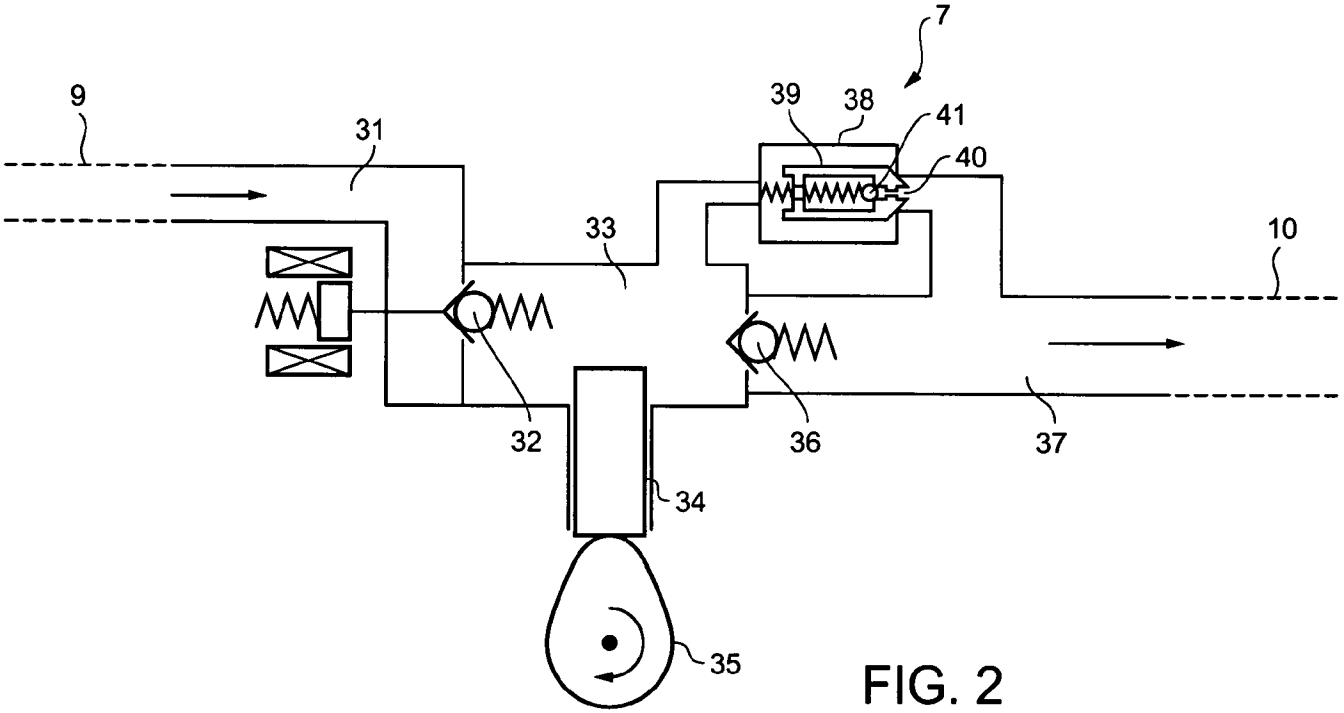
FIG. 2 shows schematically a first example of a high pressure fuel pump, which may be utilized for example in the engine illustrated in FIG. 1.

With reference to FIG. 2, there will now be described an example of a high pressure fuel pump 7 having a pressure control function valve. The high pressure fuel pump 7 of the present example is a positive displacement pump where pressure increase is provided by movement of a plunger. It will be appreciated that the disclosed concepts can be applied to other configurations of positive displacement pump as well as to other types of pumps.

The high pressure fuel pump 7 receives an input 31 of low pressure fuel from a low pressure fuel rail 9. The arriving fuel can pass through a pressure control valve 32 to enter a pressure chamber 33. The pressure control valve 32 of the present example is operated by movement of a solenoid in response to a control signal. Fuel within the pressure chamber 33 is pressurised by movement of a plunger 34, driven by a cam 35. The speed of rotation of the cam is typically set relative to the present rotation speed of the engine. The timing of the opening and closing of the pressure control valve 32 can be synchronised to the rotation of the cam 35 by use of appropriate control signals. The closing and opening timing of the pressure control valve 32 is typically controlled in order to deliver the necessary quantity of fuel to maintain the target pressure in the high pressure fuel rail 10.

Pressurised fuel within the pressure chamber 33 is able to escape via a check valve 36 to flow 37 to the high pressure fuel rail 10. In the present example, the check valve 36 a mechanical valve that is caused to open when the pressure in the pressure chamber 33 exceeds a threshold level. In the case where the check valve 36 is mechanically biased to a closed position, the threshold level is set by the force of the biasing. In the case where the check valve 36 is biased to the closed position by pressure of fuel within the high pressure fuel rail 10, the threshold level is set by the current pressure in the high pressure fuel rail 10.

Also shown in FIG. 2 is a safety valve. In the present example, this takes the form of a relatively small chamber 38 connected to both the high pressure side and to the pressure chamber 33. Within the small chamber 38, a safety valve body 39 is mechanically biased to block the flow of fuel from the high pressure side to the pressure chamber 33. The strength of biasing provided to the safety valve body 39 causes the safety valve to remain closed unless the pressure at the high pressure side (i.e., in the high pressure rail 10) reaches a predetermined safety threshold. In the present example, the safety threshold may typically be in the range of 20-25 MPa. If the safety valve is caused to open, fuel can flow from the high pressure fuel rail 10 to the pressure chamber 33. In some examples, a sensor may be provided to detect that the safety valve has opened. If a safety valve open condition is detected, various consequential measures may be taken, such as opening the pressure control valve 32 and/or opening a bypass from the high pressure fuel rail 10 to the fuel return rail 12.

The high pressure fuel pump 7 of the present example, also includes a fuel pressure control function valve. This functions to enable the pressure in the high pressure fuel rail 10 to be reduced after engine stop. When the pressure in the high pressure fuel rail 10 exceeds the threshold of the pressure control function valve, the valve opens and permits a small flow of fuel back to the pressure chamber 33. The pressure control function valve of the present example is embedded within the safety relief valve and comprises a small orifice 40 and a pressure control function valve body 41 mechanically biased to block the orifice. This is illustrated in greater detail in FIGS. 3*a* and 3*b*.

Figure 3B:
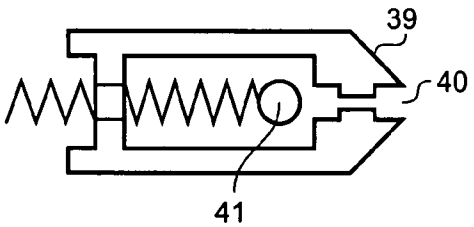
FIG. 3*b* shows schematically a pressure control function valve in an open position, which may be utilized for example in the engine illustrated in FIG. 1.
Figure 3A:
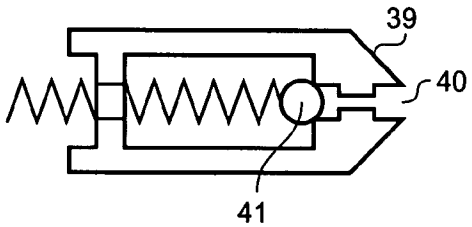
FIG. 3*a* shows schematically a pressure control function valve in a closed position, which may be utilized for example in the engine illustrated in FIG. 1.

FIG. 3*a* shows the pressure control function valve embedded within the safety valve body 39 with the pressure control function valve closed. Here the pressure control function valve body 41 is held in position to close the orifice 40 such that no flow of fuel from the high pressure rail 10 to the pressure chamber 33 is possible.

FIG. 3*b* shows the pressure control function valve embedded within the safety valve body 39 with the pressure control function valve open. Here the pressure control function valve body 41 has been forced away from the orifice 40 by the fuel pressure on the high pressure side such that a small flow of fuel from the high pressure rail 10 to the pressure chamber 33 is possible.

As the pressure control function valve is configured to allow the high pressure fuel rail 10 to drop from its normal operating pressure after engine stop, the threshold of the pressure control function valve is set to be below that normal operating pressure. In the present example, the pressure control function valve threshold may typically be in the range of 1 to 5 MPa. As such the pressure control function valve will become open at least some of the time during operation of the engine. Thus, whenever the high pressure fuel rail 10 exceeds the threshold (which may be all the time during engine operation or may be only for those periods between a pressurising stroke of the high pressure fuel pump plunger 34 and an opening of a fuel injector 11 of an engine cylinder 13) there will be a pressure loss from the high pressure fuel rail 10 via the pressure control function valve. For this reason, the orifice 40 of the pressure control function valve can be made small in order to minimise the rate of pressure loss from the high pressure fuel rail 10.

Figures 4A, 4B, 4C, 4D, 4E:
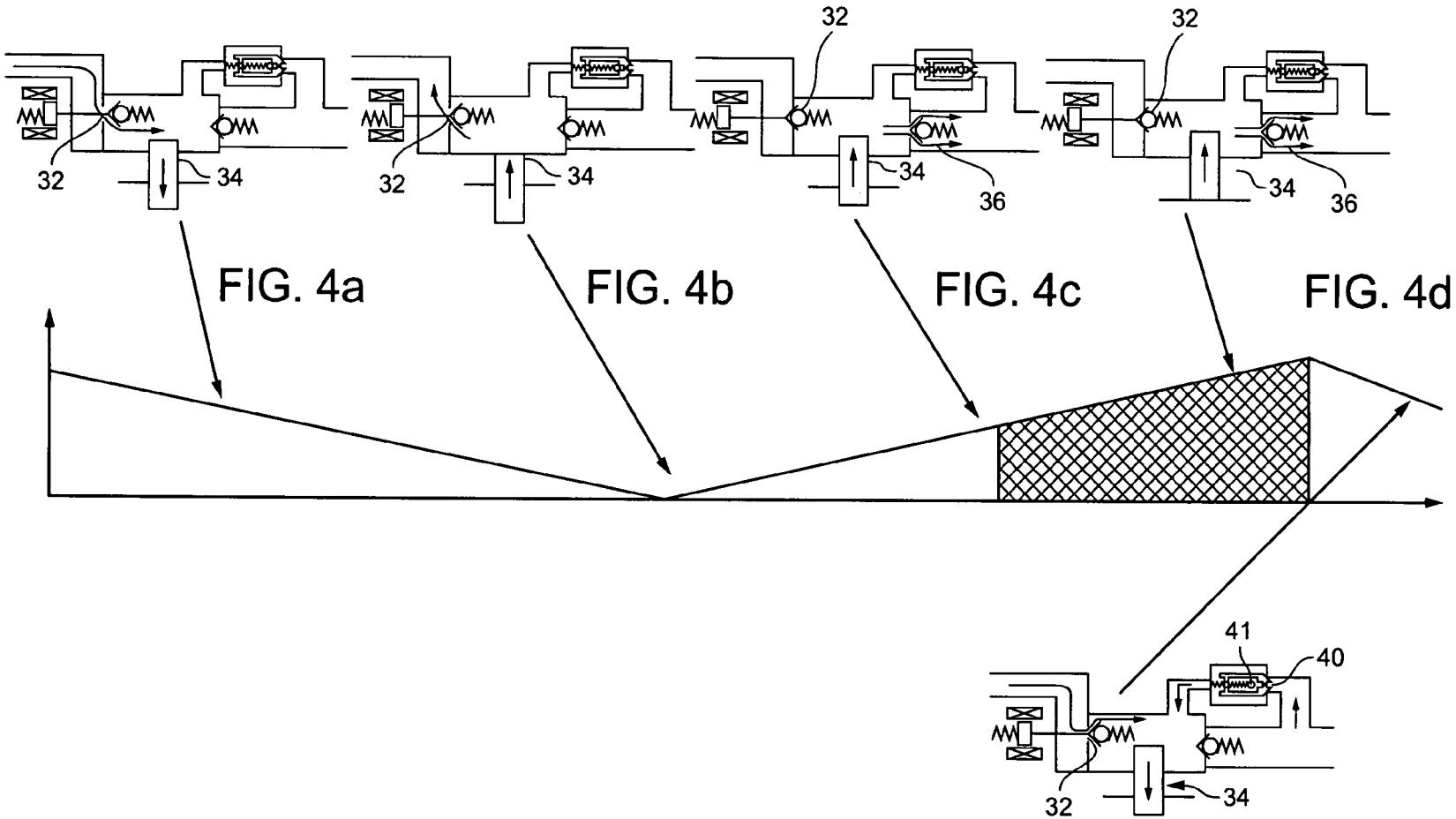
FIGS. 4*a*-4*e* illustrate a pumping cycle of a high pressure fuel pump, which may be utilized for example in the engine illustrated in FIG. 1.

FIG. 4 illustrates a pumping cycle of the high pressure fuel pump 7 of the present example. At FIG. 4*a*, the plunger 34 retracts and the pressure control valve 32 is opened to admit a new flow of fuel into the pressure chamber 33. At FIG. 4*b*, the plunger 34 starts advancing and the pressure control valve 32 is moved to close. The exact timing of the closing of the pressure control valve 32 is controlled as mentioned above to provide that the necessary quantity of fuel is delivered to maintain the target pressure in the high pressure fuel rail 10. Thus, as illustrated in FIG. 4*b*, there may be some escape of fuel back through the pressure control valve 32 before this fully closes. At FIG. 4*c* the pressure control valve 32 is completely closed and plunger 34 has continued advancing, thus increasing the pressure in the pressure chamber 33 until this exceeds the pressure necessary to open check valve 36, such that a flow of pressurised fuel to the high pressure fuel rail 10 can commence. At FIG. 4*d* the plunger 34 has further advanced such that pressure control valve 32 remains closed and check valve 36 remains open such that the delivery of fuel to the high pressure fuel rail 10 continues. At FIG. 4*e*, the plunger 34 has just commenced retracting and thus the pressure in pressure chamber 33 reduces to the level where the check valve 36 is closed. The pressure control valve 32 can then be opened to admit a flow of fuel from the low pressure fuel rail 9. Once the pressure in the chamber 33 has dropped to the level where low pressure fuel can be admitted, the pressure differential between the high pressure fuel rail 10 and the pressure chamber, and the pressure in the high pressure fuel rail 10, are such that the pressure control function valve body 41 has been forced away from the orifice 40 by the fuel pressure on the high pressure side and a small return flow of fuel from the high pressure rail 10 to the pressure chamber 33 is possible while fuel is admitted to the chamber from the low pressure fuel rail 9.

In other examples, the pressure control function valve may be open during most of the pumping cycle as the pressure in the high pressure fuel rail 10 can be expected to be higher than that of the pressure chamber 33 at all times during the cycle except when the check valve is forced open to supply pressurised fuel to the high pressure fuel rail 10 during the fuel delivery part of the cycle. In such examples, there will be constant small return flow of fuel from the high pressure fuel rail 10 except during the fuel delivery part of the cycle.

Thus there has now been described an example of an arrangement for a pressure control function valve to be provided for a high pressure fuel pump 7. Although the pressure control function valve of the present example has been described in the context of being embedded within a safety valve, other configurations as possible. For example, the pressure control function valve could be embedded within the check valve 36 (see FIG. 11) or elsewhere.

Figure 5:
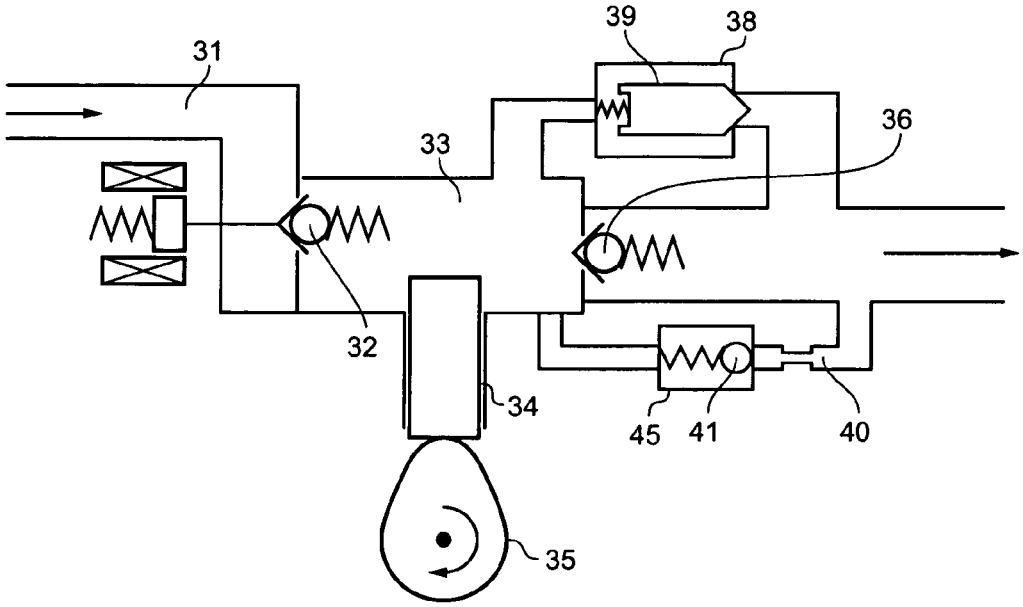
FIG. 5 shows schematically another example of a high pressure fuel pump, which may be utilized for example in the engine illustrated in FIG. 1.

FIG. 5 shows schematically another example of a high pressure fuel pump 7 in which the pressure control function valve is located separately to the other valves of the pump.

In this example, the safety valve still includes a safety valve body 39 arranged to be biased to block the passage of fuel through the small chamber 38 from the high pressure side to the pressure chamber 33 unless a threshold safety pressure is exceeded. However in this example the safety valve body 39 does not include a pressure control function valve.

The pressure control function valve of this example is provided within a separate channel 45 from the high pressure side to the pressure chamber 33. Within this channel 45 is the small orifice 40 though which the return flow of fuel can take place when the valve is open. Also present within the channel 45 is the pressure control function valve body 41 which is biased to prevent passage of fuel through the orifice unless the pressure on the high pressure fuel rail side exceeds the threshold pressure.

Thus there has now been described a further example of a high pressure fuel pump 7 having a pressure control function valve located other than within the safety valve.

Figure 6:
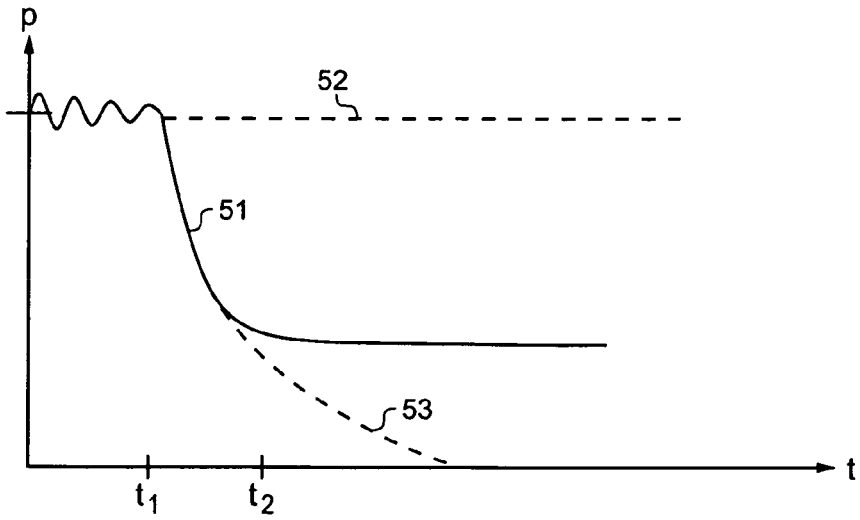
FIG. 6 illustrates a behaviour characteristic of a pressure control function valve, which may be utilized for example in the engine illustrated in FIG. 1.

FIG. 6 illustrates a behaviour characteristic of a pressure control function valve such as the pressure control function valves described above. In a plot of pressure in the high pressure fuel rail 10 against time, the solid line 51 indicates a design behaviour of the pressure control function valve. Specifically, the pressure in the high pressure rail 10 is maintained at a desired operating level (with fluctuations representing the delivery of fuel via fuel injectors and the pumping cycle of the high pressure pump 7). This desired operating level is typically around 10 MPa with typical range boundaries of 5 to 15 MPA and is maintained until engine stop at time $t_1$. At this time, no new delivery of fuel is made to the high pressure fuel rail 10 by the high pressure fuel pump 7 and so the pressure in the high pressure fuel rail 10 drops over time due to the escape through the pressure control function valve. This drop continues until the pressure in the high pressure fuel rail 10 reaches the threshold of the pressure control function valve (indicated in the figure as time $t_2$). This threshold is typically around 2 MPa with typical range boundaries of 1 to 5 MPa.

FIG. 6 also illustrates two potential erroneous behaviour characteristics of the pressure control function valve. Indicated by dashed line 52 is a behaviour that results in the situation where the pressure control function valve fails to open. In this situation, the pressure in the high pressure fuel rail 10 is not released after engine stop. As a consequence there may be a risk of injector leakage to a cylinder, if this were to occur then the next start of the engine would pump out unburned fuel from the engine before combustion which would result in undesirable emissions from the engine. This situation may be caused, for example by particles within the fuel becoming attached to or trapped in or around the orifice of the pressure control function valve, such that no flow of fuel can occur. It will be appreciated that a partial blockage of the orifice may result in a reduced speed of pressure release, resulting in a pressure release behaviour curve somewhere between curves 51 and 52 on the graph of FIG. 6. Such a partial blockage and associated reduced pressure release may cause problems in engine operation but also is likely to lead to a total blockage once a greater volume of particulate matter has built up.

A second potential erroneous behaviour characteristic of the pressure control function valve is indicated by dashed line 53. This is a behaviour that results in the situation where the pressure control function valve fails to close. In this situation, the pressure in the high pressure fuel rail 10 is released too much after engine stop as there is effectively no threshold to cause the valve to close when the pressure in the high pressure fuel rail 10 has dropped far enough. As a consequence the engine could take longer to start at the next engine start time as it would take longer to build pressure to necessary level to enable combustion to occur. Also, in hot conditions an excessively low pressure could cause a vapour lock to form with consequential failure of the engine and/or a requirement significant for maintenance activity. This situation may be caused, for example by particles within the fuel becoming attached to or trapped in or around the orifice of the pressure control function valve in the region where the pressure control function valve body should close the orifice, such that the orifice can no longer be completely closed by the pressure control function valve body and fuel can continue to flow through the orifice.

It is noted that combustion engine fuel delivery systems typically include some form of fuel filter to remove particulate matter from the fuel. However the fuel filter will have a maximum particle diameter that can pass through the filter. Although such particles will be very small, the orifice of the pressure control function valve is also small so as to prevent this valve causing a pressure loss during normal engine operation that impedes providing fuel to the high pressure fuel rail 10 at a desired pressure. Thus the pressure control function valve, and specifically the orifice thereof, may be sensitive to particles within the fuel that do not affect other fuel delivery system components.

The present examples, therefore propose approaches to cleaning of a pressure control function valve in order to avoid particle build-up in or around the orifice or pressure control function valve body in such a way as to impede proper functioning thereof.

Figure 7:
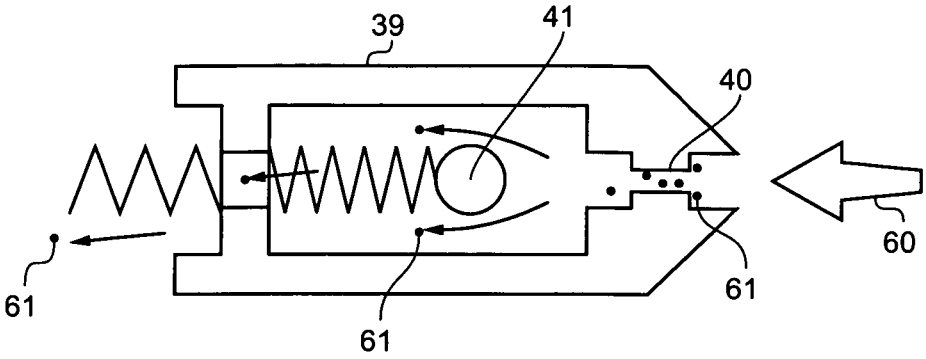
FIG. 7 illustrates a first cleaning mode for a pressure control function valve, which may be utilized for example in the engine illustrated in FIG. 1.
Figure 11:
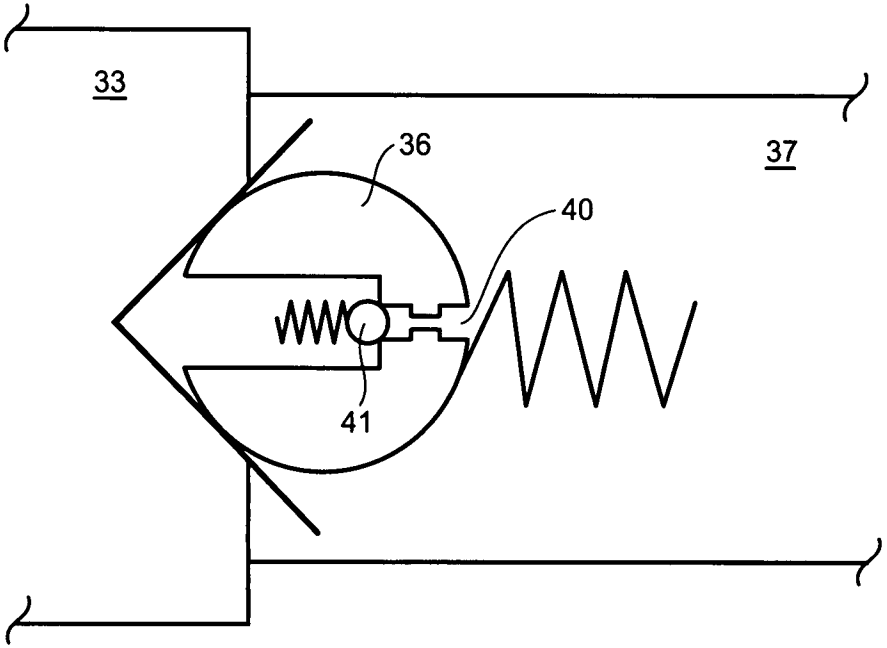
FIG. 11 shows schematically another example of a pressure control valve inserted in check valve, which may be utilized for example in the engine illustrated in FIG. 1

A first approach to cleaning of a pressure control function valve is illustrated in FIG. 7. In this example, the pressure control function valve is subjected to an overpressure condition as indicated by arrow 60. In this example, the pressure control function valve is illustrated as being embedded within the safety valve body 39, but the approach is also applicable to a pressure control function value located on its own (as shown in FIG. 5 or within, for example, the check valve 36 as shown in FIG. 11).

The overpressure condition comprises raising the pressure in the high pressure fuel rail 10 (i.e., on the high pressure side of the high pressure fuel pump 7) to approximately 3 times the normal operating pressure. In this example the normal operating pressure is about 8 MPa with a typical range boundary of 5 to 15 MPa and the overpressure condition is about 22 MPa with a typical range boundary of 15 to 25 MPa. In the present example, the overpressure condition can be above or below the threshold pressure of the safely valve (irrespective of whether the pressure control function valve is mounted in the safety valve or elsewhere). If the overpressure condition is below the safety valve threshold, then the high pressure fuel will escape via the pressure control function valve, and if the overpressure condition is above the safety valve threshold, then the high pressure fuel will escape via the pressure control function valve and the safety valve.

The pressure on the high pressure side of the pressure control function valve during the overpressure condition causes the pressure control function valve to open and a rapid flow of fuel is forced through the orifice 40 past the valve body 41. The pressure provided by the overpressure condition and the consequent rapid flow of high pressure fuel through the pressure control function valve then causes debris or contaminant build-up in or around the orifice 40 to be removed with the flow (as shown by moved particles 61). In the event that the orifice 41 had been completely blocked by particulate elements, the high pressure of the overpressure condition forces the blockage away to enable the valve to open.

Thus one approach to cleaning a pressure control function valve can take the form of subjecting the high pressure side of the valve to an overpressure condition to cause the valve to be forced open regardless of an extent of contaminant or other particulate build up in or around the valve and thereby to remove such contaminant or other particulate build up from the valve with the flow of fuel through the valve.

Figure 8:
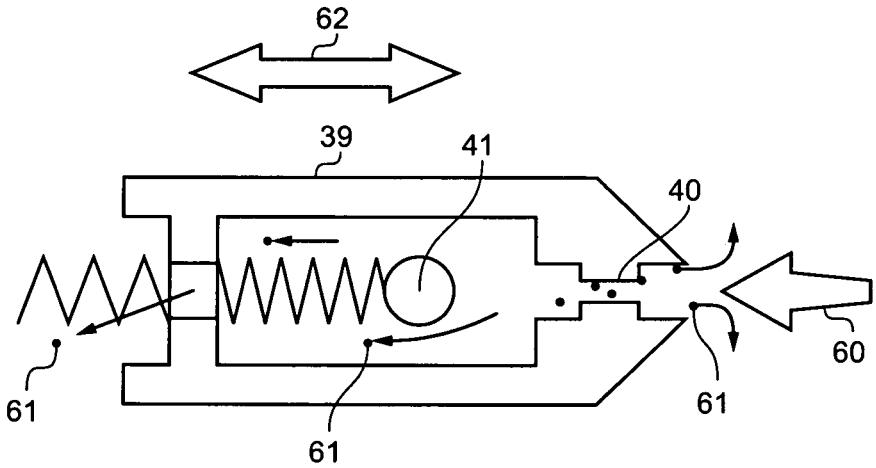
FIG. 8 illustrates a second cleaning mode for a pressure control function valve, which may be utilized for example in the engine illustrated in FIG. 1.

Another approach to cleaning of a pressure control function valve is illustrated in FIG. 8. In this example, the pressure control function valve is again subjected to an overpressure condition as indicated by arrow 60. In this example, the pressure control function valve is embedded within the safety valve body 39.

The overpressure condition comprises raising the pressure in the high pressure fuel rail 10 (i.e., on the high pressure side of the high pressure fuel pump 7) to just greater than the threshold pressure of the safety valve. In this example the threshold pressure of the safety valve is typically in the range of around 20 to 25 MPa and the overpressure condition is set to be just higher than this, for example 1 to 2 MPa higher than the safety valve threshold pressure.

By setting the pressure in the high pressure fuel rail 10 to be just higher than the safety valve threshold, this causes repeated opening and closing of the safety valve. When the high pressure pump 7 is in a delivery phase of the pump cycle, the pressure in the high pressure fuel rail 10 rises above the safety threshold, but the safety valve is not caused to open as the same pressure is present within the pressure chamber 33. Once the check valve closes and the pressure within the pressure chamber 33 starts to drop to the point where the pressure control valve is opened to admit new fuel from the low pressure fuel rail 9, the safety valve opens. Thus, when the high pressure fuel pump 7 is not in a delivery phase of the pump cycle, and when the pressure within the pressure chamber 33 of the high pressure fuel pump 7 is below that of the high pressure fuel rail 10 and the pressure of the high pressure fuel rail 10 is greater than the threshold of the safety valve, the pressure in the high pressure fuel rail 10 reduces due to flow through the safety valve and pressure control function valve until the pressure drops below the safety valve threshold and the safety valve thus closes. Maintaining this cycle of pressure fluctuation between just above and just below the safety valve threshold causes the safety valve body 39 to move repeatedly or oscillate (as shown by arrow 62) in such a way that debris or contaminant build-up in or around the orifice 40 is dislodged and/or loosened. As with the example of FIG. 7 above, the pressure on the high pressure side of the pressure control function valve during the overpressure condition causes the pressure control function valve to open and a rapid flow of fuel is forced through the orifice 40 past the valve body 41. The combination of movement of the safety valve body with the force of fuel flow though the pressure control function valve causes debris or contaminant build-up in or around the orifice 40 to be removed with the flow (as shown by moved particles 61) either by direct passage through the orifice 40 or by dislodgement away from the orifice and possible subsequent carriage with the flow of fuel through the safety valve. In the event that the orifice 41 had been completely blocked by particulate elements, the combination of vigorous movement of the safety valve body and the high pressure of the overpressure condition forces the blockage away to enable the valve to open.

Thus an approach to cleaning a pressure control function valve embedded within a safety valve can take the form of subjecting the high pressure side of the valve to an overpressure condition to cause the valve to be forced open regardless of an extent of contaminant or other particulate build up in or around the valve and to cause the safety valve oscillate between open and closed conditions and thereby subject the pressure control function valve to vibration or impulse loading and thereby to remove such contaminant or other particulate build up from the valve with the flow of fuel through the valve.

Figure 9:
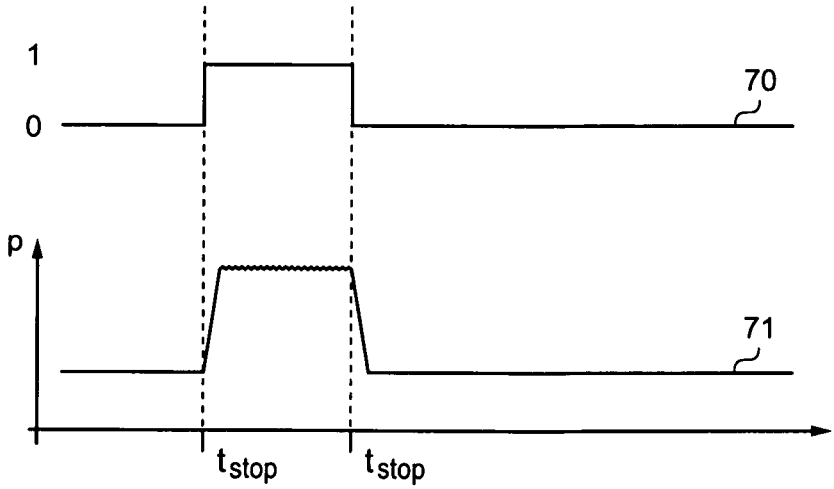
FIG. 9 illustrates a control and resultant pressure for a cleaning cycle, which may be utilized for example in the engine illustrated in FIG. 1.

With reference to FIG. 9, a control signal for controlling the operation of a cleaning cycle for a pressure control function valve and the resultant pressure are illustrated. The control signal illustrated as 70 is maintained off (for example value 0 in a binary control signal) during normal operation of the high pressure fuel pump 7. At a suitable time $t_{start}$ the control signal is switched to on (for example value 1 in a binary control signal) to commence the cleaning cycle. At a suitable time $t_{stop}$ the control signal is switched back to off. The effect of this on the pressure in the high pressure fuel rail 10 is illustrated at line 71. At time $t_{start}$ the pressure rises from the normal operating pressure to the overpressure condition pressure and then at time $t_{stop}$ the pressure falls back to the normal operating pressure.

The selection of when to perform a cleaning cycle can be pre-set or can be determined by an engine control unit 2 or by fuel pump control logic 3 of an engine control unit 2. As generating and maintaining the overpressure condition could affect normal operation of an engine supplied with fuel by the high pressure fuel pump 7, it may be appropriate to run a cleaning cycle outside of normal engine operation times. One possibility is to perform a cleaning cycle immediately after engine stop. In a stop-start engine, it might be appropriate to perform a cleaning cycle after an engine stop triggered by an engine user (such as a driver of a vehicle into which the engine is installed) but not after an engine stop triggered by an engine management unit in order that a restart is not impeded by an incomplete cleaning cycle. Another possibility is for the cleaning cycle to be performed during operating conditions such as fuel cut or max torque. Additionally or alternatively, a cleaning cycle could be triggered by a control signal that depends upon monitored behaviour of the engine. Thus, for example, a cleaning cycle could be triggered in response to detecting that pressure decrease after engine off is not working as intended.

The duration of a cleaning cycle (i.e., the time delay between $t_{start}$ and $t_{stop}$ may be pre-set to a standard cleaning cycle duration or may be controlled by an engine control unit 2 or by a fuel pump control logic 3 of an engine control unit 2.

FIG. 10 illustrates functional elements of a control capable of generating a cleaning cycle control signal 70. As will be appreciated, these functional elements may be provided by equivalent hardware elements, or the functions may be provided by multifunction hardware elements which may in turn operate under software or firmware control, of a combination of these approaches may apply.

An engine control unit 2 includes a fuel pump control logic 3 which is responsible for control signals going to the high pressure fuel pump 7 (as is also illustrated in FIG. 1). Data describing the operation of the engine are communicated 73 to a fuel pump control manager 74 which manages all forms of control to the fuel pump. In addition to a cleaning cycle control signal this may include and on/off signal to control operation of the high pressure fuel pump 7 between an inactive state (appropriate for an engine off condition) and an active state (appropriate for an engine on condition) and/or control signals for a low pressure fuel pump 5. When the fuel pump control manager 74 determines that a cleaning cycle is appropriate, it generates an output to change the control signal 70 from off to on, which control signal is carried over control signal line 6. At the end of the cleaning cycle, the fuel pump control manager 74 changes the control signal 70 back to off.

Thus an approach for deciding when to apply a cleaning cycle for a pressure control function valve and for controlling commencement and termination of that cleaning cycle has been described.

Although various examples and arrangements have been described, it is envisaged that the techniques taught in this disclosure may be implemented in further and alternative manners falling within the scope of the claims. It should be understood, therefore, that drawings and detailed description thereto are not intended to limit the invention to the particular form disclosed, but on the contrary, the invention is to cover all modifications, equivalents and alternatives falling within the spirit and scope of the present invention as defined by the appended claims.

What is claimed is:

1. A method of cleaning a fuel pump pressure control function valve of a high pressure fuel pump, the fuel pump pressure control function valve having an orifice linking a first high pressure region having a normal operating pressure and a second low pressure region, and a closing member biased to close the orifice when fuel pressure in the first region is below a threshold of the pressure control function valve, being set to be below the normal operating pressure, the pressure fuel pump having a safety valve being mechanical biased to block the flow of fuel from the high pressure region to the low pressure region and opening at a predetermined safety threshold within an overpressure condition, the method comprising:

increasing the pressure in the first region to an overpressure condition, thereby causing the closing member to be moved to open the orifice such that a rapid flow of fuel occurs from the first region to the second region and thereby cleaning the fuel pump pressure control function valve.

2. The method of claim 1, wherein the increasing the pressure in the first region to an overpressure condition comprises increasing the pressure in the first region to between 15 and 25 MPa.

3. The method of claim 1, wherein:

the fuel pump pressure control function valve is mounted in the high pressure fuel pump, the high pressure fuel pump comprising a safety valve, and increasing the pressure in the first region to an overpressure condition comprises increasing the pressure in the first region to a pressure over the threshold pressure of the safety valve.

4. The method of claim 3, wherein the fuel pump pressure control function valve is mounted in the safety valve.

5. The method of claim 3, wherein the increasing the pressure in the first region to a pressure over the threshold pressure of the safety valve comprises increasing the pressure in the first region to between 1 and 2 MPa greater than the threshold pressure of the safety valve.

6. The method of claim 1, wherein:

the fuel pump pressure control function valve is mounted in the high pressure fuel pump, the high pressure fuel pump comprising a check valve, and the fuel pump pressure control function valve is mounted in the check valve.

7. The method of claim 1, wherein:

the fuel pressure control function valve is mounted in the high pressure high pressure fuel pump, the high pressure fuel pump configured to deliver pressurised fuel to a high pressure fuel rail, and the first region is in fluid communication with the high pressure fuel rail.

8. An engine management system comprising:

a fuel pressure control output having a configuration to convey a fuel pump control signal;

a fuel pump control manager having a configuration to:

decide when a cleaning cycle of a fuel pump pressure control function valve should take place;

adjust the fuel pump output control signal to cause the fuel pump to increase output pressure to an overpressure condition in response to a decision that the cleaning cycle of the fuel pump pressure control function valve should take place;

wherein the fuel pump pressure control function valve is a component of a high pressure fuel pump and the fuel pump pressure control function valve comprises an orifice linking a first high pressure region having a normal operating pressure and a second low pressure region, and a closing member biased to close the orifice when fuel pressure in the first region is below a threshold of the pressure control function valve being set to be below the normal operating pressure, wherein the high pressure fuel pump includes a safety valve being mechanically biased to block the flow of fuel from the high pressure region to the low pressure region and opening at a predetermined safety threshold within an overpressure condition, wherein the pressure in the first region is configured to be increased to an overpressure condition, thereby causing the closing member to be moved to open the orifice such that a rapid flow of fuel occurs from the first region to the second region and thereby cleaning the fuel pump pressure control function valve.

9. The system of claim 8, wherein the overpressure condition comprises increasing the output pressure to between 15 and 25 MPa.

10. The system of claim 8, wherein:

the high pressure fuel pump comprises a safety valve, and the overpressure condition comprises increasing the output pressure to a pressure over the threshold pressure of the safety valve.

11. The system of claim 10, wherein the fuel pump pressure control function valve is mounted in the safety valve.

12. The system of claim 10, wherein the output pressure over the threshold pressure of the safety valve is between 1 and 2 MPa higher than the threshold pressure of the safety valve.

13. The system of claim 8, wherein:

the high pressure fuel pump comprises a check valve, and the fuel pump pressure control function valve is mounted in the check valve.

14. The system of claim 8, wherein the fuel pump control manager has a configuration to decide that the cleaning cycle of the fuel pump pressure control function valve should take place following an engine stop.

15. A pressure control function valve, the valve comprising:

a pressure return orifice via which high pressure fuel can escape from a high pressure region having a normal operating pressure to a low pressure region; and a closing member operatively biased to close the pressure return orifice when the fuel pressure is below a threshold of the pressure control function valve, being set to be below the said normal operating pressure;

wherein the pressure return orifice is arranged to be cleaned by use of an overpressure condition in the high pressure region; and wherein the pressure control function valve is a component of a high pressure fuel pump.

16. The valve of claim 15, wherein the overpressure condition comprises a pressure in the high pressure region of between 15 and 25 MPa.

17. The valve of claim 15, wherein:

the pressure control function valve is mounted in the high pressure fuel pump, the high pressure fuel pump comprising a safety valve, and the overpressure condition comprises a pressure in the high pressure region higher than the threshold pressure of the safety valve.

18. The valve of claim 17, wherein the fuel pump pressure control function valve is located in the safety valve.

19. The valve of claim 17, wherein the pressure in the high pressure region higher than the threshold pressure of the safety valve is between 1 and 2 MPa higher than the threshold pressure of the safety valve.

20. The valve of claim 15, wherein:

the pressure control function valve is mounted in the pressure fuel pump, the high pressure fuel pump comprising a check valve, and the fuel pump pressure control function valve is mounted in the check valve.

* * * * *